US008011359B1

(12) United States Patent
Schultz

(10) Patent No.: US 8,011,359 B1
(45) Date of Patent: Sep. 6, 2011

(54) AUXILIARY SMOKE ARRESTING UNIT

(76) Inventor: Christopher T. Schultz, Viroqua, WI (US)

( * ) Notice: Subject to any disclaimer, the term of this patent is extended or adjusted under 35 U.S.C. 154(b) by 250 days.

(21) Appl. No.: 12/386,741

(22) Filed: Apr. 21, 2009

Related U.S. Application Data

(63) Continuation of application No. 11/186,141, filed on Jul. 20, 2005, now abandoned.

(51) Int. Cl.
*F24C 15/00* (2006.01)

(52) U.S. Cl. ..... 126/80; 126/77; 126/112; 126/550; 126/163 R

(58) Field of Classification Search ..... 126/80, 126/77, 307 R, 312, 550, 112, 163 R
See application file for complete search history.

(56) References Cited

U.S. PATENT DOCUMENTS 2,468,108 A * 4/1949 Rich ..... 126/242
3,404,875 A * 10/1968 Hall ..... 266/78
5,462,043 A * 10/1995 Rose et al. ..... 126/110 R

* cited by examiner

*Primary Examiner* — Alfred Basichas
(74) *Attorney, Agent, or Firm* — M. Paul Hendrickson

(57) ABSTRACT

Smoke escaping from an outdoor wood burning furnace may be effectively arrested with a smoke arresting unit. By mounting a smoke gathering manifold above the furnace door operatively connected to a vacuum source for drawing smoke discharging from the furnace chamber through an open furnace door, the gathered and arrested smoke may be discharged through a separate discharging chimney. The vacuum source may be activated when the furnace fan is switched off and the furnace door is opened for refueling.

8 Claims, 7 Drawing Sheets

AUXILIARY SMOKE ARRESTING UNIT

This application is a continuation application of U.S. patent application Ser. No. 11/186,141 entitled Auxiliary Smoke Arresting Unit filed on behalf of Christopher T. Schultz on Jul. 20, 2005 and hereby incorporated by reference herein.

FIELD OF INVENTION

The present invention relates to smoke arresting systems and more particularly to a smoke arresting unit for furnace chambers containing smoke laden gases and its use.

BACKGROUND OF THE INVENTION

Wood burning furnaces have been extensively used throughout the northern tier of the United States of America to heat buildings. Many of these outdoor wood burning furnaces include a heat conduit for conducting the heated air or heated radiated liquids to an externally disposed house from the wood burning furnace. An outdoor wood furnace is typically equipped with a wood burning fire box or furnace chamber within which the solid combustible fuels are burned, a fire box door for providing access to the furnace chamber, a chimney for exiting smoke laden gases from the furnace chamber, a heat conduit for conducting heat to the building to be heated, and a furnace fan which provides sufficient air to fan the combustible fuels within the fire box. In a normal operation, the fan is typically engaged during the combustion of the solid combustible fuel material. Most outdoor furnaces are also equipped with a furnace fan switching mechanism which stops the furnace fan upon opening the fire box door. Since the furnace fan typically blows the smoke laden gases out the chimney, the disengagement of the furnace fan tends to create a considerable amount of entrapped smoke within the fire box. Thus, when the furnace door is open, a large amount of smoke laden gases usually expels through the open furnace door rather than exiting through the furnace chimney. Consequently, the tender or operator of a wood furnace often reeks with smoke laden clothing and sometimes chokes due to the smoke laden fumes escaping from the furnace door. This typically happens on those occasions when it becomes necessary to refuel the furnace box with wood. It would be extremely desirable if there existed a smoke arresting system which would prevent the accumulation of smoke laden gases within the furnace box when the furnace fan has been disengaged for purposes of allowing access to the furnace box. This would permit the furnace tender to open the furnace box door without being bombarded with bottled-up smoke.

SUMMARY OF THE INVENTION

The present invention provides a smoke arresting unit useful in evacuating smoke from a furnace chamber equipped with an electronically regulated furnace fan for fanning burning embers within the furnace chamber. The smoke arresting unit of this invention comprises a smoke gathering manifold for receiving smoke laden gases from the furnace chamber, a conduit connected to the smoke gathering manifold for evacuating the smoke laden gases gathered by said manifold from said chamber, a vacuum source for drawing the smoke laden gases through the manifold and the conduit to an exiting site, and a switching member which activates the vacuum source when it becomes desirable to remove or evacuate the smoke laden gases emitted from the furnace chamber. The smoke arresting unit of this invention enables the tender of the wood burning furnace to safely open the furnace chamber door without being onslaughted by a hazardous flow of bellowing of smoke from the furnace chamber. This allows the furnace tender to refuel the furnace chamber with new fuel without experiencing the undesirable onslaught of smoke laden gases upon ones person.

DETAILED DESCRIPTION OF THE INVENTION

Figure 1:
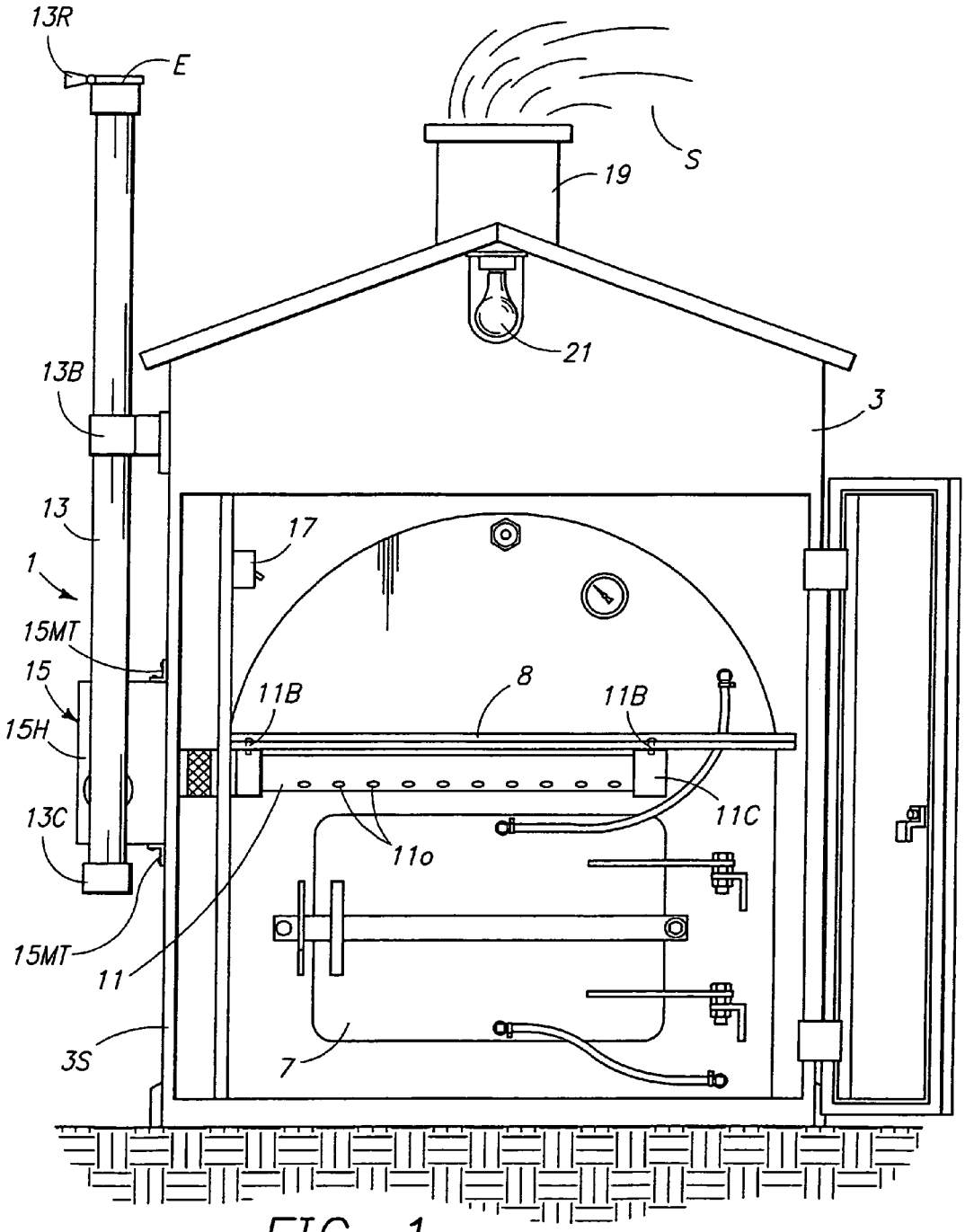
FIG. 1 depicts an external frontal elevational view of an outdoor wood burning furnace equipped with the smoke arresting unit of this invention.

With reference to FIGS. 1-7, there is provided pursuant to the present invention a smoke arresting unit 1 useful for evacuating smoke S from a furnace chamber 5 when opening a furnace door 7 of a furnace 3 containing smoking embers. The smoke arresting unit 1 is particularly adapted for use in a furnace chamber 5 equipped with an electronically regulated furnace fan 9 for fanning burning embers of a solid combustible material such as wood. The smoke arresting unit 1 prevents smoke from errantly escaping from a furnace chamber 5 when refueling. The smoke arresting unit 1 generally comprises a smoke gathering manifold 11 for receiving smoke laden gases S from said furnace chamber 5, a conduit 13 for exiting the smoke laden gases S gathered by said manifold 11 at a desired smoke emitting site E from said chamber 5, a vacuum source 15 for gathering and conducting the gas laden gases S through said manifold 11 and the conduit 13, and a switching member 17 for activating the vacuum source 15 when it becomes desired to capture escapable smoke laden gases S generated within said furnace chamber 5. The smoke arresting unit 1 is designed to arrest smoke which is prone to escape through an open furnace door 7 from the furnace chamber 5.

Figure 2:
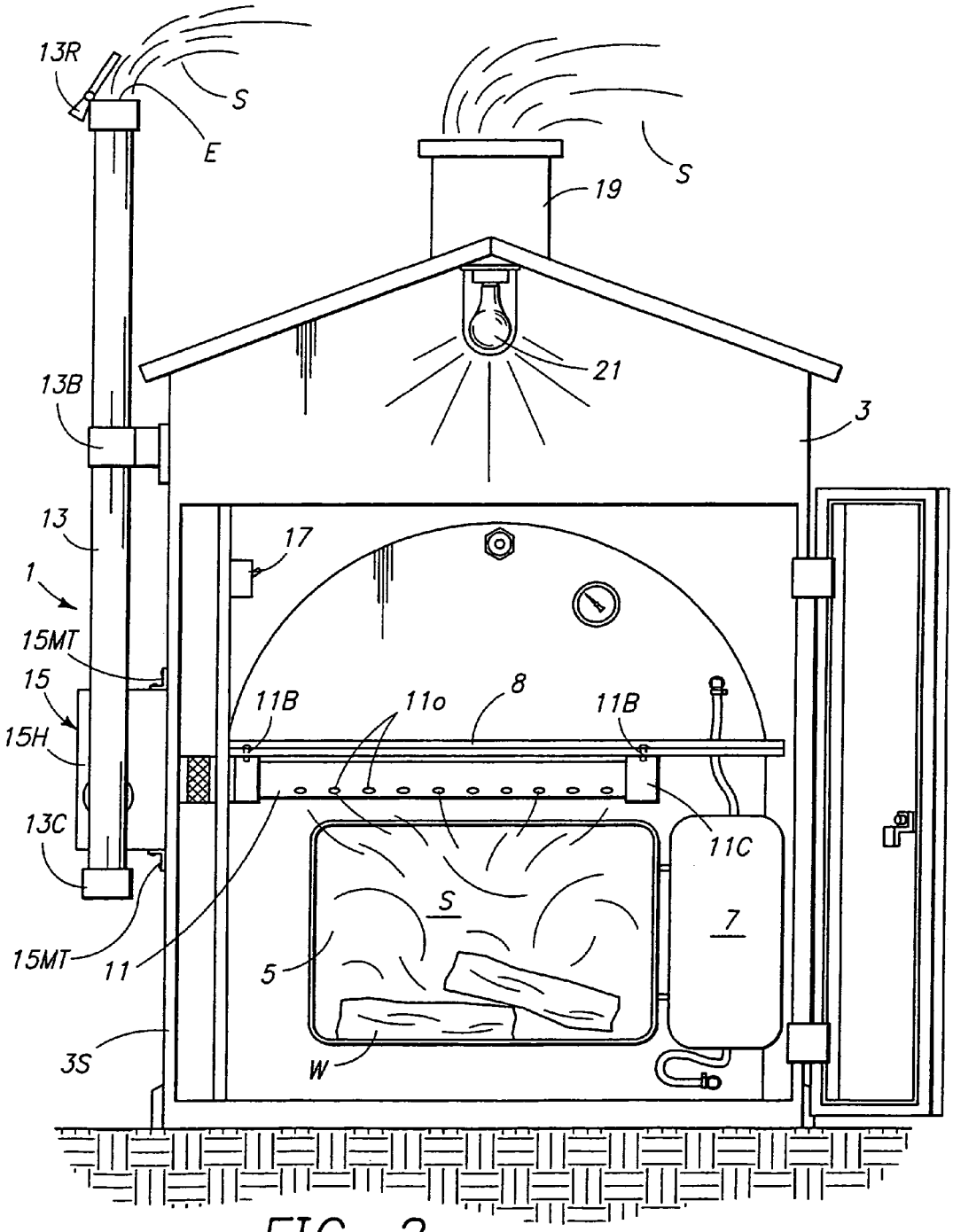
FIG. 2 is a frontal view of the smoke arresting unit of FIG. 1 with fire box door of the wood burning furnace in an open position.
Figure 3:
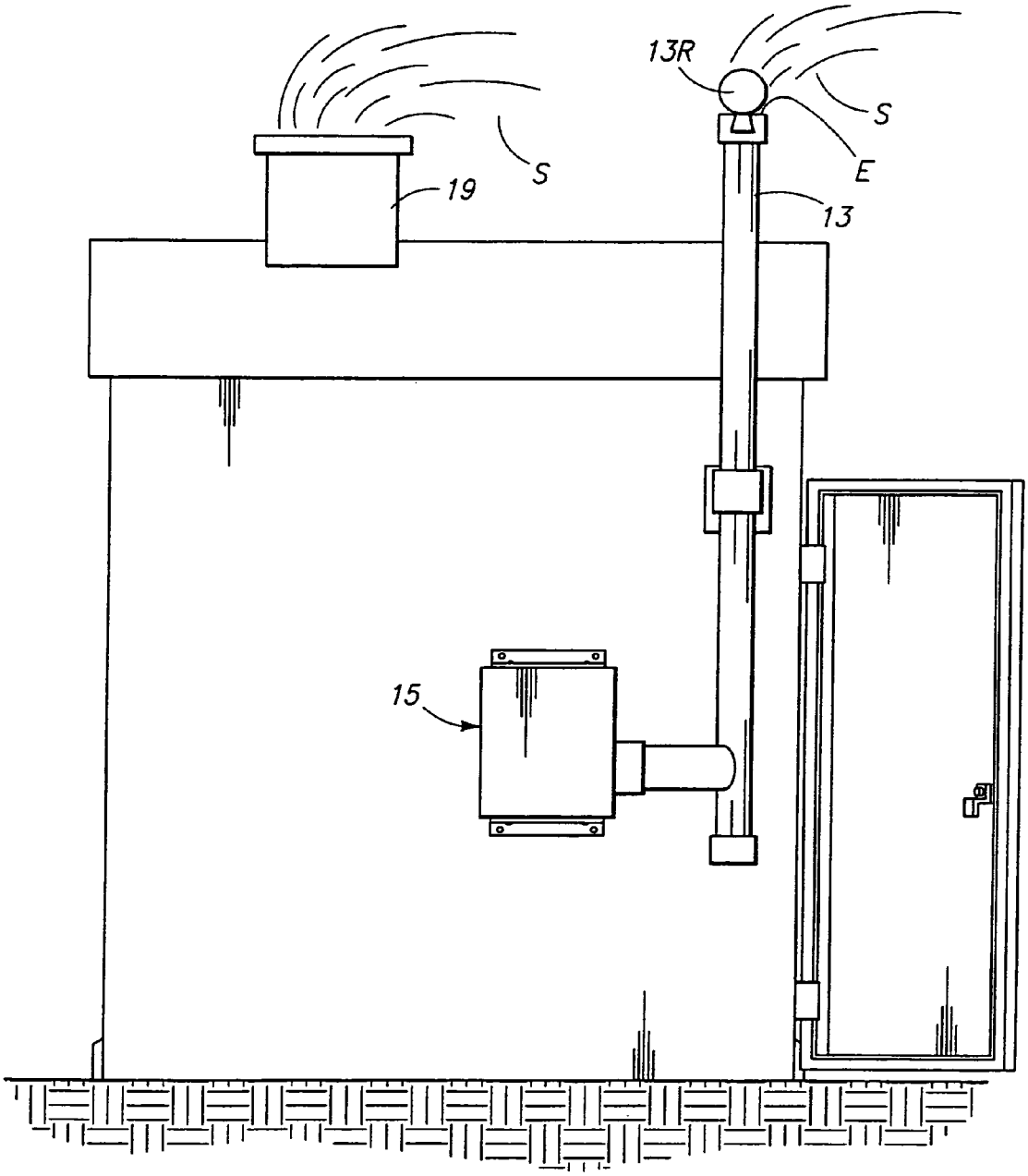
FIG. 3 is a side view of the furnace equipped with the smoke arresting unit shown in FIG. 1.
Figure 4:
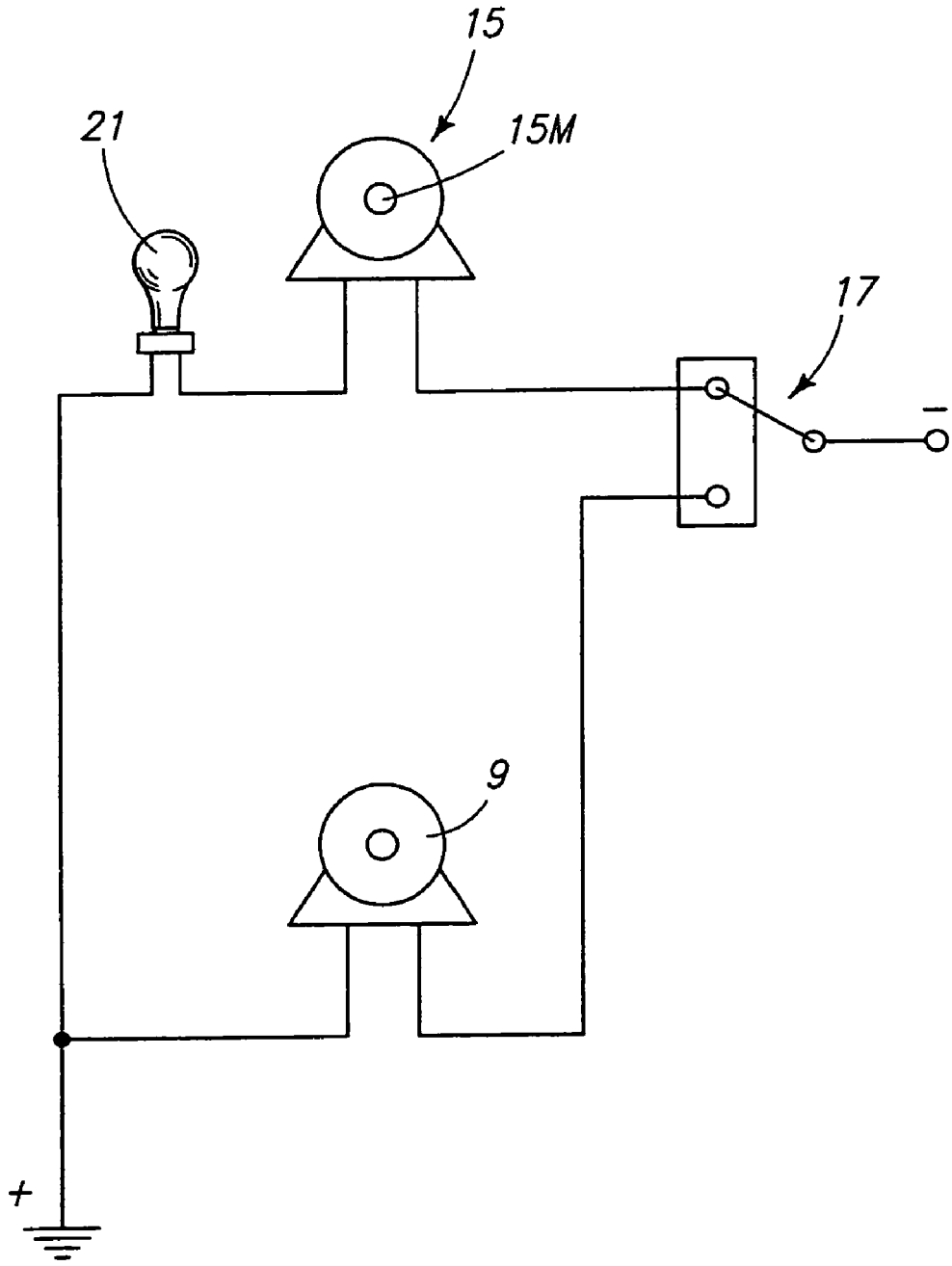
FIG. 4 is a schematic circuitry showing the wiring diagram for the furnace equipped with the smoke arresting unit shown in FIG. 1.
Figure 5:
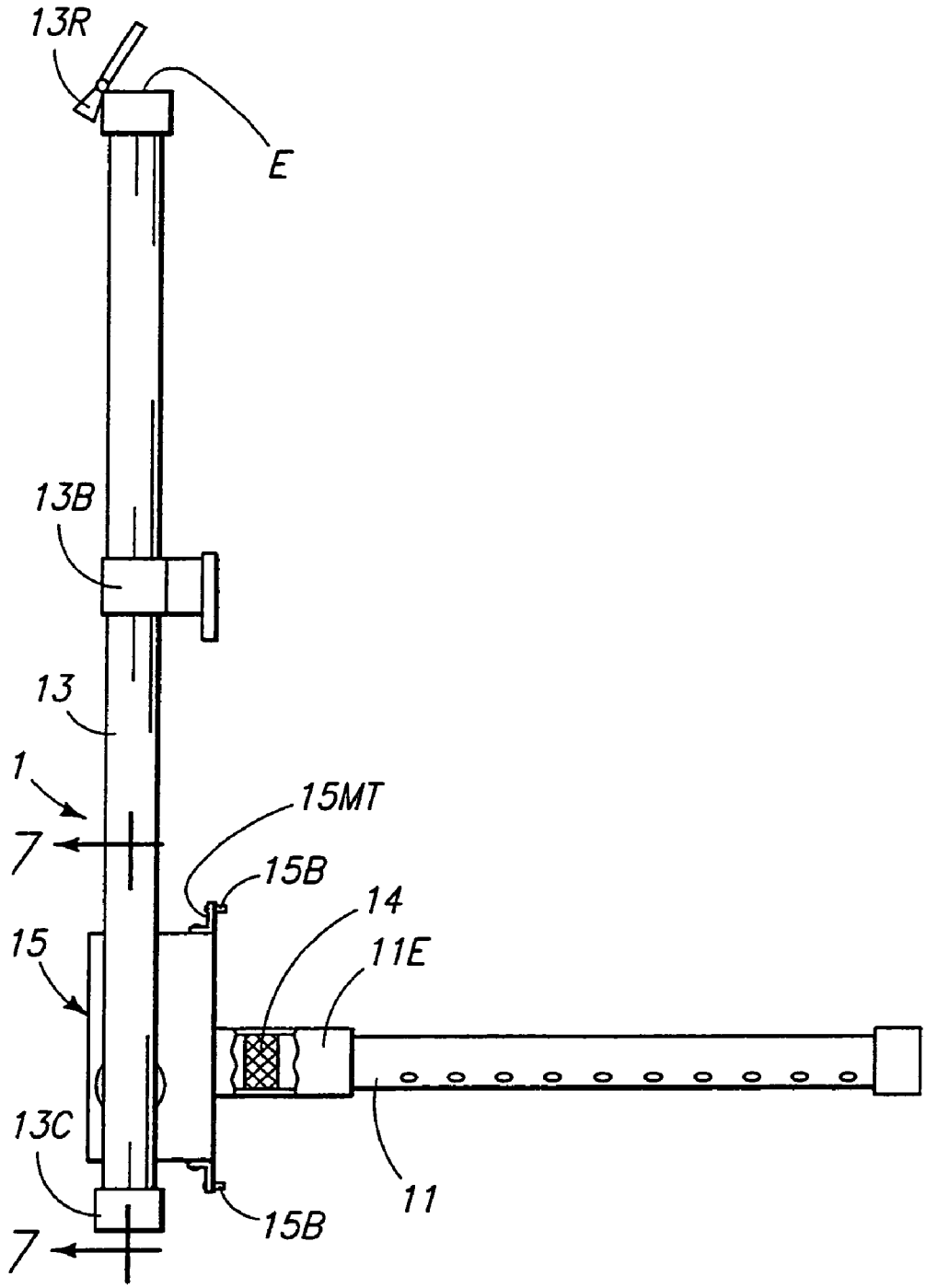
FIG. 5 depicts an detached frontal view of the smoke arresting unit shown in FIG. 1.

Smoke S is generated most abundantly in an absence of sufficient air to combust the combustibles W within the confinement of a furnace chamber 5. In the normal furnace operation, a draft created by a furnace fan 9 typically fans and provides adequate air to assist in the burning of combustibles W and thereby create heat within the furnace chamber 5. When it becomes necessary to refuel the furnace chamber 5, the furnace fan 9 is typically disengaged which customarily leads to an excessive accumulation of smoke S within the furnace chamber 5. Most furnaces 3 are equipped with an alert light 21 which is switched "on" when the furnace fan 9 is switched "off". This may be accomplished by a manual switch separately switched or combined with a furnace door 7 opening as depicted in FIG. 4. Thus, when the furnace fan 9 is disengaged, smoke will not be forced out of the chamber 5 through a furnace chimney 19 by the furnace fan 9 but rather tends to latently accumulate within the furnace chamber 5. The smoke arresting unit 1 herein is designed to eradicate the errant escape of smoke S from a chamber 5 by arresting or capturing the smoke S before it becomes errantly discharged to the outside environment from an open furnace door 7. The smoke arresting unit 1 may be provided as an auxiliary smoke arresting unit 1 adapted for external attachment to a conventional wood burning furnace 3 as depicted in FIGS. 1-3 or as a specially designed smoke arresting unit 1 for special use and installation within the confines of the furnace chamber 5 as illustrated by the phantom lines in FIG. 6. Irrespective of whether the vacuuming inlet or source 15 for removing the smoke S is internally disposed within the furnace chamber 5 or externally positioned outside the furnace chamber 5, the vacuum source 15 is most appropriately designed so as to be activated upon an opening of a furnace door 7 of a furnace chamber 5 containing an excess of escapable smoke S.

The smoke arresting unit 1 is particularly adapted for use in combination with an exterior wood burning furnace 3 conventionally equipped with a fire box or burning chamber 5 for burning solid combustibles W such as wood, an electronic fan 9 for fanning or aerating the burning wood W with external air, a chimney 19 for exiting smoke laden fumes S from the farmed combustibles W within the fire box chamber 5, a fire box or furnace door 7 for gaining access to the fire box chamber 5, and a switching member 17 for switching the electronic fan 9 to an "off" or stopped fanning position when it is desired by an operator to gain access to said fire box chamber 5. In a normal operation, the smoke arresting unit 1 will become activated when the electronic fan 9 is switched "off" and typically before opening the fire box door 7 for refueling. The smoke arresting unit 1 of this invention when activated serves to capture smoke laden gases S from errantly escaping from the fire box chamber 5 when the fire box door 7 is opened. The smoke arresting unit 1 comprises a gas or smoke gathering manifold 11 for gathering the smoke laden gases S, a smoke conduit 13 for conducting smoke laden gases S gathered by said gas gathering manifold 11 to a smoke discharging site E external to the fire box chamber 5, a vacuum source 15 for drawing the smoke laden gases S from said fire box chamber 5 to the smoke discharging site E and a switching member 17 for activating the vacuum source 15 when it is desired to evacuate or capture the smoke laden gases S before escaping from the fire box chamber 5.

Figure 6:
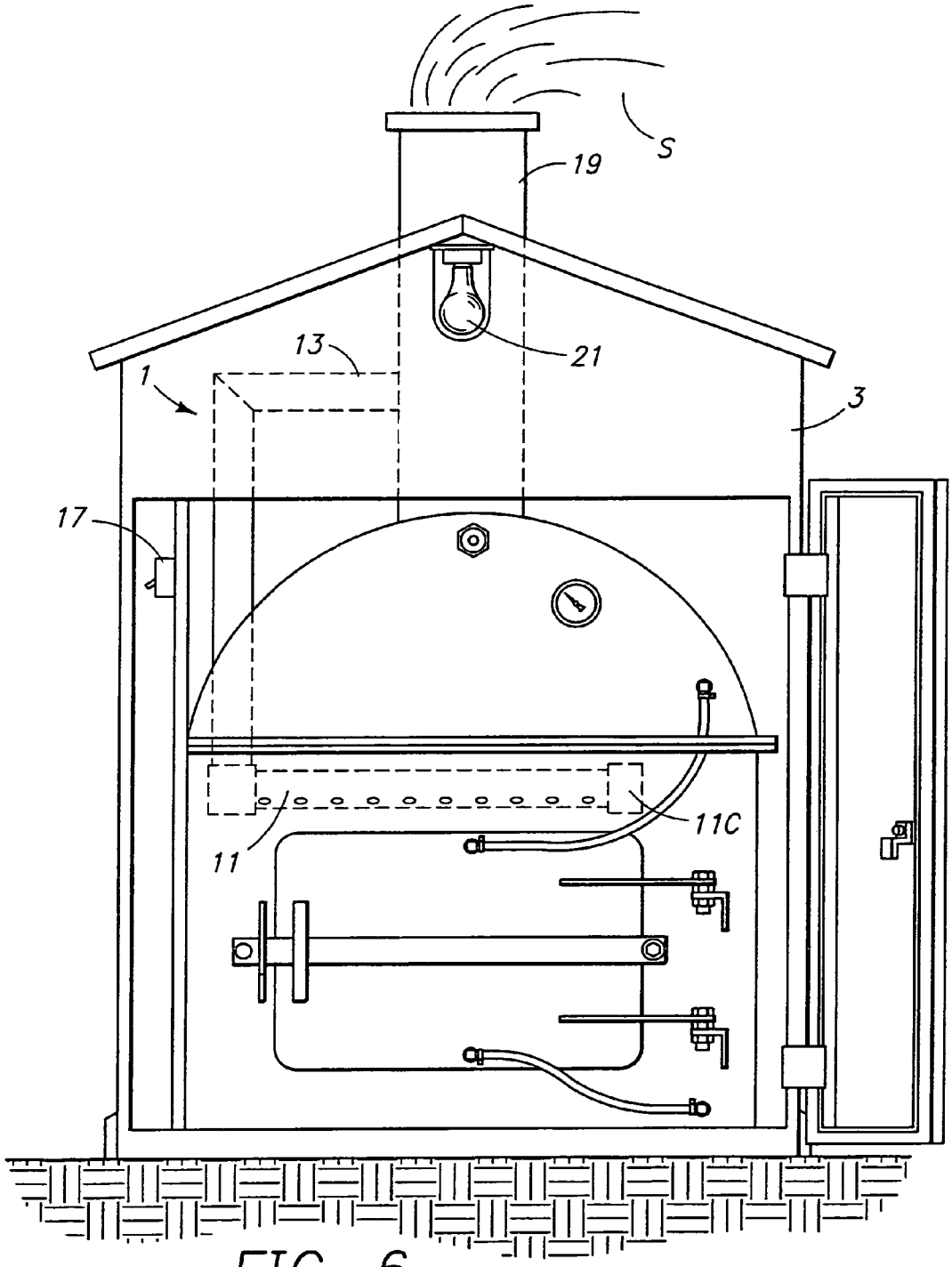
FIG. 6 depicts another embodiment of the invention wherein the smoke arresting unit depicted by phantom lines has been internally installed within the furnace chamber rather than externally as shown in FIG. 1.

The smoke arresting unit 1 when assembled onto a furnace 3 containing burning combustibles serves to arrestingly capture and discharge captured smoke S at a distal site E before its errant discharging from an opened furnace door 7. This may be accomplished by placing the smoke gathering manifold 11 about or above the furnace door as depicted in FIGS. 1 and 2 or within the furnace chamber 5 as illustrated by FIG. 6. The smoke arresting unit 1 may be provided as an attachment 1 (as illustrated separately in FIG. 5) adapted to exteriorly attach or mount onto a conventional wood burning furnace. The attachment 1 is further equipped with an exiting conduit 13 having an independent exiting site E from the furnace chimney 19 as depicted in FIGS. 1-3 and 5. The externally mounted attachment 1 requires mounting to the furnace 3 as depicted in FIGS. 1-3 and wiring of the vacuum source motor 15M in series with the alert light 21 as illustrated by FIGS. 2 and 4. The smoke gathering manifold 11 may alternatively be placed within the fire box chamber 5 as shown in FIG. 6.

The vacuum source 15 for capturing quiescent smoke S generated within the furnace chamber 5 upon switching the furnace fan 9 "off" and opening the furnace door 7 may be appropriately activated when it becomes necessary to capture escapable smoke S from the furnace chamber 5. Activation of the vacuum source 15 may be effectuated in a number of different ways. For example, a separate vacuum activated switch 17 may be simply manually activated by the furnace operator so as to switch the vacuum source 15 to an "on" or operative position when it becomes necessary to open the furnace door 7 as depicted in FIG. 2. Alternatively, the furnace door 7 may be equipped with a switching member 17 which automatically switches the vacuum source 15 to an "on" position when the furnace door 7 is opened.

Since most wood burning furnaces 3 as depicted by FIGS. 1-2 are equipped with a furnace fan switch 17 to manually switch the furnace fan 9 "off" and an alert light 21 "on" as a prelude to opening the furnace door 7, the switching member 17 for activating the vacuum source 15 may be suitably integrated into the electronic circuitry of the existing alert light 21 and furnace fan switch 17 as depicted by FIG. 4. Thus, when the operator deactivates or switches "off" the furnace fan 9, the vacuum source 15 is switched "on" in conjunction with the alert light 21 by a double throw switch 17 serving as an activating switching member 17 as depicted by the electrical circuitry of FIG. 4. In certain wood burning furnace systems, the furnace fan 9 may shut "off" upon opening the furnace door 7. By combining the vacuum source activating switching member 17 with furnace fan circuitry, switching or activating the vacuum source 15 upon an alert light 21 being switched on upon opening of the furnace door 7 may also be incorporated into the existing furnace fan 9 switching circuitry.

FIG. 4 depicts an electrical schematic diagram of how the present invention may be furnished as an auxiliary smoke arresting unit 1 readily adapted to existing wood burning furnaces as currently marketed. If it is conventional to switch 17 the furnace fan 9 "off" and an alert light "on" as a prelude to opening the furnace door 7 as depicted in FIG. 2, the furnace fan switch 17 may also be utilized as a switching member 17 for switching on the vacuum source motor 15. In certain conventional furnace 3 systems, switch 17 is used to disengage the fan motor 9 "off" and to simultaneously switch "on" an alert light 21 so as to alert the furnace operator that the fan motor 9 is not running or disengaged. By modifying the existing furnace fan and alert light 21 circuitry so as to switch the vacuum motor 15 "on" upon disengagement of the furnace fan 9 as shown in FIG. 4, the same fan switch 17 may be used to serve as a switching member 17 to switch the vacuum motor 15 when the alert light circuitry 21 is switched "on". Thus, when the alert light 21 is "on" the furnace operator knows that the furnace fan 9 has been disengaged and the vacuum motor fan 15 has been switched to the "on" position. When the refueling of the furnace 3 is completed the furnace operator simple throws the furnace fan switch 17 back to the "on" position for engaging the fan motor 9 and thereby disengaging the vacuum source motor 15 and the alert light 21.

The vacuum source 15 may be created by various different vacuum creating systems all of which will effectively create a vacuum and draw smoke S into the smoke gathering manifold 11. The preferred embodiment involves a squirrel cage fan 15F powered by an electric motor 15M operated so as to create a vacuum and draw smoke through the smoke arresting unit 1. Other vacuum sources 15 may include a vacuum pump, a venturie vacuuming system for drawing smoke (not shown) or any other conventional vacuum sources 15 for creating a vacuum.

Figure 7:
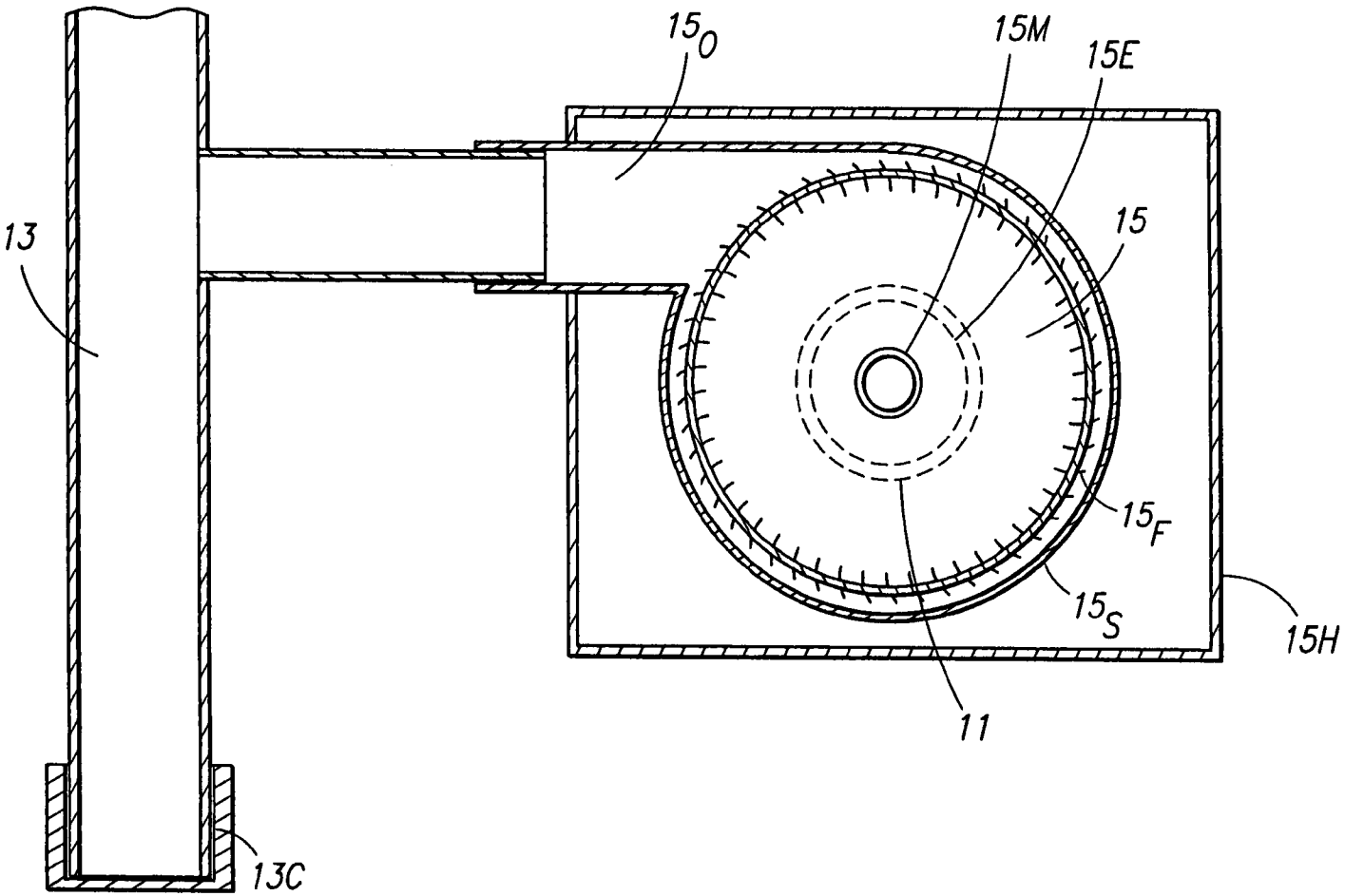
FIG. 7 is an enlarged cross-sectional view taken along line 7-7 of FIG. 5.

The enlarged cross-sectional view of FIG. 7 shows in greater detail how the smoke collecting manifold 11 may be operationally connected to a conventional forced air furnace fan as the vacuum source 15 and the smoke exiting conduit 13. The depicted vacuum source 15 of FIG. 7 comprises a squirrel caged housing 15S housing fan 15F and equipped with a 4 inch stove pipe inlet 15E housing an in-line filter 14 and chimney exhaust 15*o* for exiting smoke onto the exiting smoke conduit 13. A conventional furnace squirrel caged motor and fan as often used to withdraw and circulate heated air through a forced air furnace system may be effectively used as a vacuum source 17. The size of the vacuum source 17 may be altered to suit the amount of smoke in need of arresting or gathering by the smoke arresting unit 1. Exemplary of an exteriorly mounted vacuum source 17 is an A.O. Smith furnace fan marked as being equipped with a 1/10 horsepower universal electric motor 15M (e.g. Tipp City, Ohio, thermally protected) SCR 09P2117R, S Mod CASF107N, 115 volt, 60/50 Hz, 3.4/3.8 Å 1570/1330 RPM Class B, 110S MAX AMB 40° C. CFM 500 Cont A CWSE Stock #9465. Any type of forced air furnace fan designed to withdraw heated air from a furnace and circulate it through forced air ducts may be used for this purpose. The squirrel caged furnace fans equipped with stove pipe inlets and outlets are particularly adaptable for use herein. The larger sized vacuum source motors 15M will generally be more effective in vacuuming the smoke S than the smaller sized units.

The manifold 11 may be suspended above the furnace door 7 by bolting the manifold 11 to the furnace 3 with anchoring bolts 11B such as onto an existing furnace 3 ledge 8 as depicted in FIGS. 2 and 3. The vacuum source 15 as depicted is suitably protectively housed in a housing 15H such as a galvanized sheet of metal housing 15H measuring 10½ inches in both width and depth and 12½ inches in height flanged or equipped with a mounting bracket 15MT which allows the vacuum source 15 to be directly attached with bolts or screws 15B onto a furnace sidewall 3S as depicted in FIGS. 1 and 2.

The auxiliary mounted smoke arresting unit 1 as depicted in FIGS. 1-5 is designed for attachment to a conventional wood burning furnace. The attachment which generally requires cutting and removing from the external furnace sidewall 3 a sufficient passageway so as to permit for the installation of the smoke arresting unit 1 onto the furnace 3.

With particular reference to FIGS. 1-3, it will be observed that the auxiliary smoke arresting unit 1 includes a mounting bracket 13B for mounting the chimney 13 to the furnace 3 such as with anchoring bolts or screws. A protective rain cap 13R protectively caps the chimney 13 from rain and snow while closure cap 13C closes the opposite end of chimney 13.

An exteriorly mounted manifold 11 such as depicted in FIGS. 1-3 and 5 may be illustratively constructed of 4 inch diameter galvanized stove pipe measuring 30 inches in length capped at one end with manifold cap 11C with the opposite end adapted to snuggly fit onto stove pipe extension 11E housing an in-line filter 14 (e.g. such as a fiber glass matting) which filters the gathered smoke before it is discharged onto the squirrel caged rotary fan 15F of vacuum source 15. The smoke arresting manifold 11 may be illustratively equipped with rowed (e.g. three rows of ¼ inch diameter holes) arresting apertures 11*o* equidistantly spaced about the bottom (e.g. 30-45° arc) of the manifold 11 so as to uniformly collect or arrest smoke escaping the furnace chamber 5 from an open furnace door 7.

The smoke gathering manifold 11 is connected to a smoke conduit 13 which discharges captured smoke S at a distal smoke discharges site E from an open furnace door 7. The smoke conduit 13 may be a separate chimney as illustrated in FIGS. 1-3 and 5 or as a smoke conduit 13 which exits the collected smoke into a common furnace chimney as illustrated in FIG. 6. The most suitable smoke discharging site E will depend upon whether or not the smoke arresting unit 1 may be easily adapted to the existing commercially available systems or especially tailored at a factory for internal installation.

Most existing outdoor wood burning furnaces 3 rely upon the furnace chimney 19 as the smoke discharging site E and do not include the necessary hardware to allow for easy conversion of an existing smoke discharging system to an integrated smoke arresting unit 1. As mentioned, the smoke arresting unit 1 may be operatively integrated into the wood burning furnace system to accommodate a smoke system manifold 11 and a smoke conduit 13 system within the furnace chamber box 5 as depicted by FIG. 6 which conducts the captured smoke S to the furnace chimney 19 or other suitable smoke discharging site E. In contrast, the smoke arresting unit 1 as depicted by FIGS. 1-5 may be separately manufactured and sold as a smoke arresting attachment 1 which may be externally installed onto an existing wood burning furnace 3 lacking the necessary internal furnace chamber 5 components to adapt the present invention thereto. A separate chimney conduit 13 and externally disposed vacuum source 15 as depicted in FIGS. 1-3, 5 and 7 provides a particularly effective smoke arresting unit 1 for existing outdoor wood burning furnaces 3.

There is also provided pursuant to the present invention, a method for removing smoke laden gases S from a furnace chamber 5 of a furnace 3 containing solid combustible materials W being burned within said furnace chamber 5, said furnace 3 being equipped with a fire box door 7 providing access to said furnace chamber 5, a chimney 19 for externally discharging smoke from said furnace chamber 5, an electrical switch 17 for switching the furnace fan circuitry 9 and a smoke arresting unit 1 for evacuating smoke laden gases S from the furnace chamber 5 when the furnace fan 9 is switched off for purposes of obtaining access to the furnace chamber 5 through said fire box door 7, with said smoke arresting unit 1 including a smoke gathering manifold 11 for gathering the smoke laden gases S from said chamber 5, a smoke exiting conduit 13 for exiting gathered smoke laden gases S to an external site E from said furnace chamber 5, a vacuum source 15 for drawing said smoke laden gases S through said manifold 11 and the exiting conduit 13 to said external site E, and an activating or switch member 17 for activating the vacuum source 15 when it is desired to gain access to the furnace chamber 5 through said fire box door 7 while the furnace fan 9 is in the switched off position, said method comprising:

a) causing the furnace fan 9 to be switched to the off position;

b) allowing smoke laden gases S to be evacuated from the furnace chamber 5 with said smoke arresting unit 1;

c) refueling the furnace chamber 5 through the fire box door 7 with fuel W;

d) closing the fire box door 7; and e) switching the furnace fan 9 to the open position so as to permit the furnace fan 9 to draw air onto the fuel W within the furnace chamber 5.

What is claimed is:

1. A smoke arresting unit useful for arresting and discharging smoke escaping from a furnace chamber of a wood burning furnace equipped with a furnace chimney, a furnace door and an electronically regulated furnace fan for fanning burning embers when the furnace door is closed and stops the fanning of the burning wood embers when the furnace door is opened, said smoke arresting unit consisting essentially of a smoke gathering manifold for vacuuming into said manifold smoke laden gases escaping from said furnace chamber when said furnace door is opened, a smoke conduit for conducting the smoke laden gases vacuumed into said manifold, a mountable separate smoke emitting chimney separated from said furnace chimney for externally emitting the smoke laden gases conducted thereto by said conduit, an electronically powered vacuum source for vacuuming said gases into said manifold and conducting the smoke laden gases through said manifold onto said conduit and onto said mountable separate smoke emitting chimney and an electronic switching member for activating the vacuum source when it becomes desired to arrest the smoke laden gases escaping from said furnace chamber when said door is open and mounts for exteriorly mounting said unit onto said wood burning furnace.

2. The smoke arresting unit according to claim 1 wherein the smoke conduit and the vacuum source are equipped with mounting members for the external mounting of the conduit and vacuum source onto the furnace.

3. The smoke arresting unit according to claim 1 wherein the vacuum source consists of a motor driven vacuum generating fan operatively connected and disposed between said separate chimney and said manifold.

4. A combination of an externally mounted smoke attachment and an exterior wood burning furnace equipped with a fire box chamber for burning wood, an electric fan for fanning the burning wood with air, a furnace chimney for discharging smoke laden fumes from the fire box chamber, a fire box door for gaining access to the fire box chamber, and a switching member for switching the electronic fan to an off position when it is desired to gain access to said fire box chamber through said fire box door wherein the externally mounted smoke arresting attachment when activated serves to arrest smoke laden gases escaping from said fire box chamber upon opening the fire box door and switching of the electronic fan to the off position, with said smoke arresting attachment consisting essentially of an externally mounted smoke gathering manifold for arresting the smoke laden gases escaping from said chamber upon the opening of the fire box door, an externally mounted smoke conduit for conducting the smoke laden gases arrested by said smoke gathering manifold, an externally mounted separate chimney separate from said furnace chimney for receiving and discharging the smoke laden gases conducted thereto by said conduit, a vacuum source for drawing the smoke laden gases into said smoke gathering manifold and conducting the smoke laden gases arrested by the smoke gathering manifold through said smoke conduit onto said separate chimney and a switching member for activating the vacuum source when it is desired to arrest the gas laden gases escaping from said fire box chamber upon the opening of the fire box door with said smoke arresting attachment.

5. The combination according to claim 4 wherein the switching member simultaneously switches the vacuum source to an on smoke gathering position when said electronic fan for said furnace is switched to the off position.

6. The combination according to claim 5 wherein the gas gathering manifold is laterally mounted along a bordering margin above the furnace door so as to arrest the smoke laden gases being omitted from an open furnace door.

7. The combination according to claim 4 wherein the separate chimney for discharging smoke laden gases when said electric fan is engaged in a fanning position is laterally disposed from the furnace chimney and the manifold is equipped with arresting apertures positioned so as to uniformly collect and arrest smoke laden gases escaping an open fire box door.

8. A method for using a smoke arresting unit for arresting smoke laden gases escaping from a furnace chamber of a wood burning furnace containing burning wood within said furnace chamber, wherein said furnace is equipped with a fire box door for providing access to said furnace chamber, a furnace chimney for externally discharging the smoke laden gases from said furnace chamber, a furnace fan for fanning burning wood embers within said furnace chamber, and an electrical switching circuitry for switching the furnace fan to an on fanning position and an off position upon an opening of the fire box door; wherein said smoke arresting unit consists essentially of a smoke gathering manifold for arresting the smoke laden gases escaping from the furnace chamber upon the opening of the fire box door and the switching of the furnace fan to the off position, a smoke conduit for exiting the smoke laden gases by the smoke gathering manifold onto a separate chimney which serves as a separate external smoke discharging site externally disposed from said furnace chimney, a vacuum source for drawing said smoke laden gases into said manifold and discharging the gases through the smoke conduit onto the separate chimney, and an activating member for activating the vacuum source when it is desired to gain access to the furnace chamber through said fire box door when the furnace fan is in the switched off position, said method consisting essentially of:

a) causing the furnace fan to be switched to the off position and an activation of the vacuum source so as to capture smoke laden gases escaping from said furnace chamber through the open fire box door with said smoke arresting unit;

b) capturing the escapable smoke laden gases by arresting the gases under vacuum with said smoke gathering manifold while discharging the captured vacuumed gases onto the external discharging site through said smoke conduit and said separate chimney with said smoke arresting unit;

c) refueling the furnace chamber with wood through the fire box door while capturing and discharging said captured gases at said separate external smoke discharging site; and d) closing the fire box door and deactivating the vacuum source; and e) switching the furnace fan to the on fanning position so as to permit the furnace fan to draw air onto the burning wood embers and fan the burning embers within the furnace chamber.

* * * * *